US008028807B2

(12) United States Patent
Deplazes et al.

(10) Patent No.: US 8,028,807 B2
(45) Date of Patent: Oct. 4, 2011

(54) REMOTE RECORDING OF MAINTENANCE OPERATIONS FOR AN ELEVATOR OR ESCALATOR INSTALLATION

(75) Inventors: Romeo Deplazes, Kloten (CH); Christian Bodmer, Cham (CH)

(73) Assignee: Inventio AG, Hergiswil NW (CH)

( * ) Notice: Subject to any disclaimer, the term of this patent is extended or adjusted under 35 U.S.C. 154(b) by 718 days.

(21) Appl. No.: 11/718,981

(22) PCT Filed: Nov. 7, 2005

(86) PCT No.: PCT/CH2005/000650

§ 371 (c)(1), (2), (4) Date: Mar. 10, 2008

(87) PCT Pub. No.: WO2006/050626

PCT Pub. Date: May 18, 2006

(65) Prior Publication Data

US 2008/0283342 A1 Nov. 20, 2008

(30) Foreign Application Priority Data

Nov. 9, 2004 (EP) ..... 04105604

(51) Int. Cl.
*B66B 1/34* (2006.01)

(52) U.S. Cl. ..... 187/391; 187/247

(58) Field of Classification Search ..... 187/247, 187/248, 391, 393; 702/179
See application file for complete search history.

(56) References Cited

U.S. PATENT DOCUMENTS 3,973,648 A * 8/1976 Hummert et al. ..... 187/393
4,330,838 A * 5/1982 Yoneda et al. ..... 702/122
4,512,442 A * 4/1985 Moore et al. ..... 187/393
4,561,093 A * 12/1985 Doane et al. ..... 714/46
4,697,243 A * 9/1987 Moore et al. ..... 706/59
4,771,865 A * 9/1988 Hinderling ..... 187/391
4,823,914 A 4/1989 McKinney et al.
5,557,546 A * 9/1996 Fukai et al. ..... 702/185
5,616,894 A * 4/1997 Nieminen et al. ..... 187/247
6,330,935 B1 * 12/2001 Systermans ..... 187/391
6,516,923 B2 * 2/2003 Lence Barreiro et al. .... 187/391
7,004,289 B2 * 2/2006 Shrum et al. ..... 187/393
7,073,633 B2 * 7/2006 Weinberger et al. ..... 187/393

(Continued)

FOREIGN PATENT DOCUMENTS

EP 1415947 A1 5/2004

(Continued)

*Primary Examiner* — Anthony Salata

(74) *Attorney, Agent, or Firm* — Fraser Clemens Martin & Miller LLC; William J. Clemens

(57) ABSTRACT

A method and device for maintenance of an elevator installation or an escalator installation communicates the presence of a maintenance technician at the elevator or escalator installation to a remote service center. The service center is thus informed about that the maintenance technician has to maintain or is maintaining or has maintained a specific installation and is in a position of checking the quality of this maintenance. The maintenance operations are recorded as a maintenance record and communicated to the service center. For example, the maintenance record contains details about which maintenance technician on which day of the year and for how long has undertaken which maintenance operations on a specific elevator or escalator installation. The quality of a thus detected maintenance can then be compared with a quality standard. In addition, the maintenance operations performed are thus uniquely detected and can be evaluated.

14 Claims, 3 Drawing Sheets

U.S. PATENT DOCUMENTS

| | | | | |
|---|---|---|---|---|
| 7,172,055 | B2 * | 2/2007 | Engel et al. | 187/391 |
| 7,398,860 | B2 * | 7/2008 | Amano | 187/247 |
| 7,699,142 | B1 * | 4/2010 | Wurth et al. | 187/391 |
| 2004/0240627 | A1 | 12/2004 | Nakajima | |

FOREIGN PATENT DOCUMENTS

| | | | |
|---|---|---|---|
| JP | 11272972 | A | 10/1999 |
| JP | 2003067877 | A | 7/2003 |
| WO | WO 03029122 | A | 4/2003 |

* cited by examiner

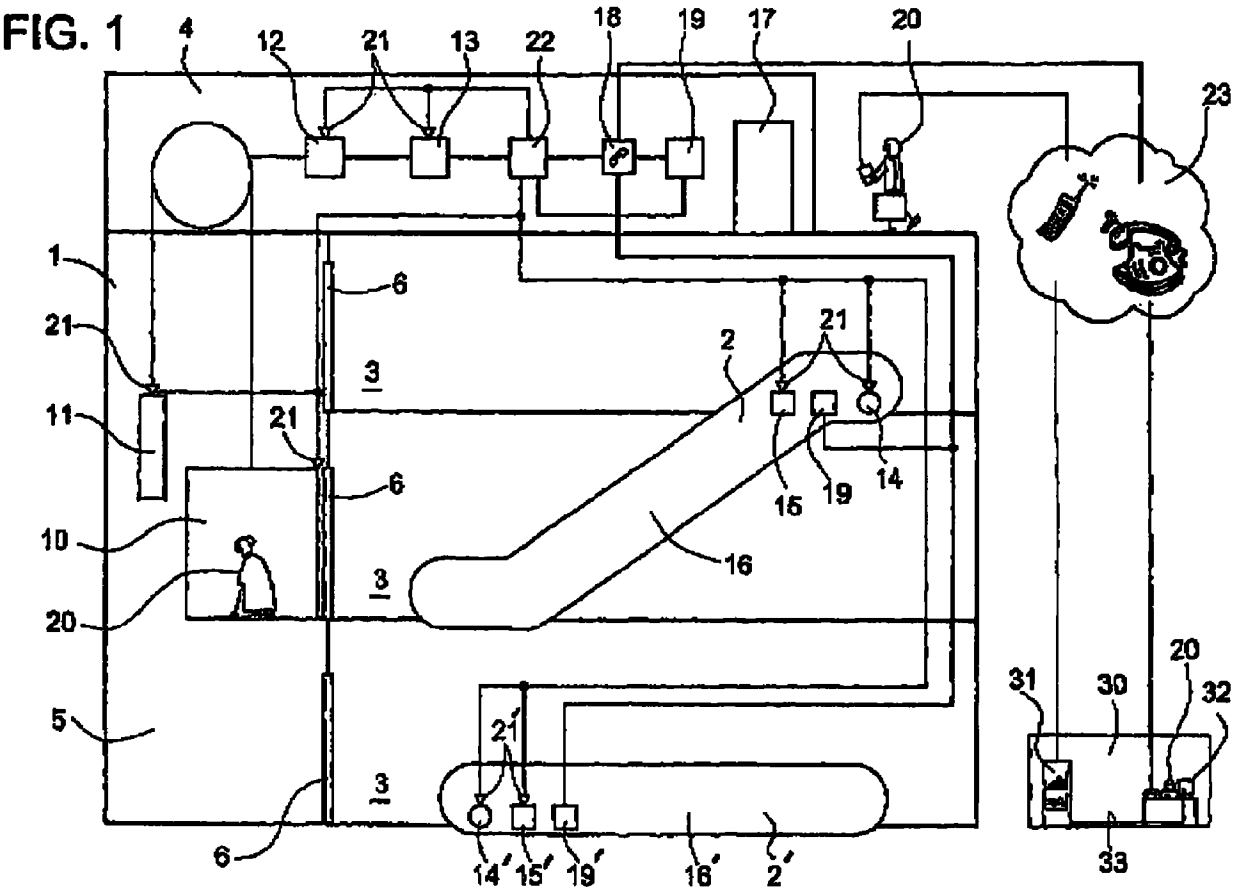

FIG. 1

REFERENCE NUMERAL LIST 1 elevator installation
2 escalator installation
2' roller belt installation
3 floor
4 engine room
5 shaft
6 shaft door
7 building management office
10 car
11 counterweight
12 drive
13 control device
14, 14' drive
15, 15' control device
16, 16' balustrade
17 door
18 data transmission device – modem
19, 19' input and recognition unit
20 maintenance technician
21, 21' sensor
22 evaluating unit
23 telephone network
30 service center
31 data processing installation
32 computer
33 data bus
34 customer

REFERENCE NUMERAL LIST 1 elevator installation
2 escalator installation
2' roller belt installation
3 floor
4 engine room
5 shaft
6 shaft door
7 building management office
10 car
11 counterweight
12 drive
13 control device
14, 14' drive
15, 15' control device
16, 16' balustrade
17 door
18 data transmission device – modem
19, 19' input and recognition unit
20 maintenance technician
21, 21' sensor
22 evaluating unit
23 telephone network
30 service center
31 data processing installation
32 computer
33 data bus
34 customer

FIG. 4

REMOTE RECORDING OF MAINTENANCE OPERATIONS FOR AN ELEVATOR OR ESCALATOR INSTALLATION

FIELD OF THE INVENTION

The present invention relates to a method and a device for maintenance of an elevator installation or an escalator installation.

BACKGROUND OF THE INVENTION

The maintenance of an elevator installation or escalator installation includes lubrication and cleaning of components, checking of the installation, release of persons, adjustment and re-adjustment operations as well as repair work necessitated by wear and abrasion. The maintenance does not include cleaning of externally disposed regions of the installation, cleaning of the car interior, exchange of principal components of the installation such as a drive, a car, a control, safety components, etc., exchange of the installation, modernization of the installation and release of persons by the fire brigade. The maintenance is carried out by a maintenance undertaking or a maintenance technician.

EP 1415947 A1 discloses a method for remote maintenance of an elevator installation or an escalator installation, in which the unusual states of the elevator installation or escalator installation are reported to a remote service center by way of, for example, modern communication means. This makes it possible to carry out from the service center a checking and diagnosis of the serviceability of the elevator installation or escalator installation.

SUMMARY OF THE INVENTION

A first object of the present invention is to establish a quality standard for maintenance, particularly remote maintenance, of elevator or escalator installations and to check the quality of such maintenance with this quality standard. A further object of the present invention is to design the maintenance of the elevator installation or escalator installation to be flexible in correspondence with customer wishes. In addition, it is an object of the present invention to keep maintenance costs low. Finally, it is an object of the present invention to communicate the serviceability of the elevator installation or escalator installation to the customer after an outlay. The objects shall be fulfilled by known and proven means from the field of transport.

The present invention fulfils the first of the objects in that it provides a method for maintenance of an elevator installation or an escalator installation in which the presence of at least one maintenance technician at an elevator installation or an escalator installation is communicated to a remote service center. This can take place in real time or delayed in time. The service center is thus informed about the fact that a maintenance technician has to maintain or is maintaining or has maintained a specific elevator installation or escalator installation and is in a position of checking the quality of this maintenance. The maintenance operations are recorded as a maintenance record and communicated to the service center. For example, the maintenance record contains details about which maintenance technician on which day of the year and for how long has undertaken which maintenance operations on a specific elevator or escalator installation. The quality of a thus detected maintenance can then be compared with a quality standard. In addition, the maintenance operations performed are thus uniquely detected and can be evaluated.

Advantageously, the maintenance technician is identified at the elevator installation or escalator installation or the technician is identified by reporting at the service center. For example, the maintenance technician inputs at least one identification code at a recognition unit at the elevator installation or maintenance installation. The input identification code is compared with a reference and if an authorization is present, i.e. if the identification code is recognized, the maintenance technician is identified. In a variant thereof a recognition can take place of at least one admittance feature by the recognition unit at the elevator installation or escalator installation. Thus, the maintenance technician is identified on the basis of positional localization in a network at the elevator installation or escalator installation. In this manner the quality of maintenance can be associated with a specific, identified maintenance technician. It can also then be checked whether the maintenance technician of a maintenance firm has an authorization for maintenance operations and for which the maintenance operations this authorization is valid. The three aforesaid variants can be used individually or in combination.

Advantageously the conclusion of the maintenance operations is recorded and the service center checks, after conclusion of the maintenance operations, the state as well as the serviceability of the elevator installation or escalator installation. It is thus ensured that the elevator or escalator installation after the maintenance operations also actually functions and any deficiencies have been eliminated.

Advantageously the service center communicates the maintenance record to the customer of the elevator installation or escalator installation. The maintenance record can thus serve as a basis for charging in which the maintenance operations are communicated to the owner after a recorded expense.

Advantageously the elevator installation or escalator installation ascertains the maintenance requirement thereof itself and reports this maintenance requirement to the service center or the maintenance technician. For example, the elevator installation or escalator installation has a maintenance detection device which detects the most diverse state data by sensors and an evaluating unit and compares these data with reference data and thus determines a maintenance requirement. In this manner the service center or the maintenance technician is informed in advance about maintenance operations to be carried out, which saves time and costs. Thus, the maintenance technician knows already before arrival at the elevator or escalator installation whether and which replacement parts will be needed and can already take these along on a first visit.

In a variant the maintenance requirement is advantageously determined by the service center itself and communicated to the maintenance technician. For this purpose the state data are communicated by the elevator installation or escalator installation to the service center and compared by the service center with reference data in order to thus determine a maintenance requirement. The maintenance requirement is thus flexibly oriented towards the level of serviceability desired by the customer.

Advantageously the elevator installation or escalator installation determines the maintenance state thereof itself and displays it. Thus, for example, the current maintenance state of the elevator installation or escalator installation can be called up on site.

The present invention moreover fulfils the first of the tasks by a device for identification of a maintenance technician. For example, this device regulates access to a non-public region of the elevator installation or escalator installation. For example, the device identifies a maintenance technician with the help of at least one identification code input at an input unit or by recognition of at least one admittance feature. Advantageously the identification is communicated to the service center in real time or delayed in time or carried out by the service center at least in part steps. The maintenance operations are recorded as a maintenance record and this maintenance record is communicated to the service center. The service center thus knows which maintenance technician was present at a specific elevator installation or escalator installation and which maintenance operations this maintenance technician has carried out and can check the quality of this maintenance.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 shows, schematically, a first embodiment of an elevator installation or an escalator installation in which the presence of a maintenance technician is reported by telephone network to a remote service center;

FIG. 4 is a list of reference numerals used in FIGS. 1-3.

DESCRIPTION OF THE PREFERRED EMBODIMENT

Figure 2:
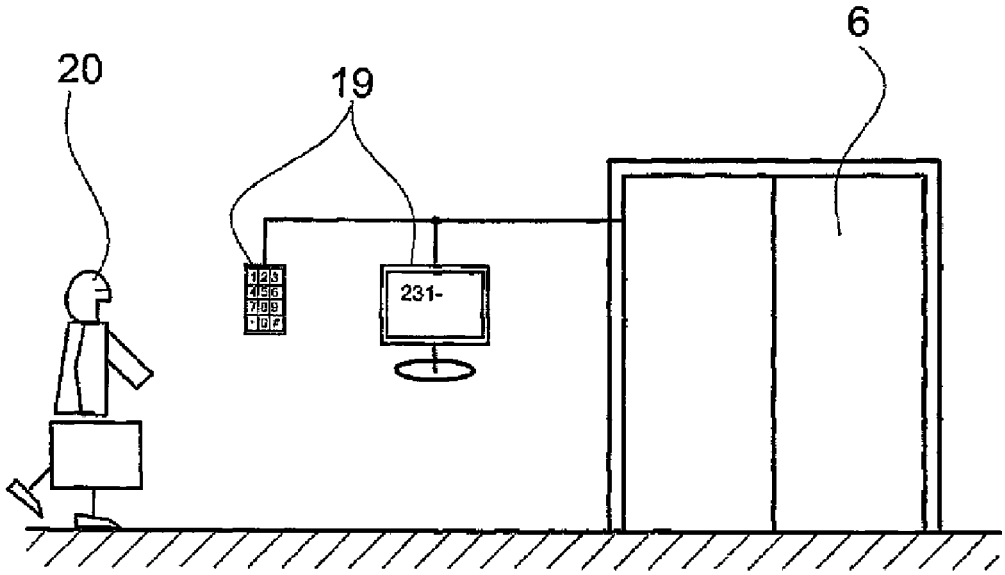
FIG. 2 shows the identification of a maintenance technician at an elevator installation or escalator installation according to FIGS. 1.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

With respect to the elevator installation or escalator installation: FIG. 1 shows an elevator installation 1 and an escalator installation 2, which are arranged in any building and comprise at least one elevator or at least one escalator. The installation can be any known elevator installation 1 which comprises components such as a car 10 for movement of passengers or goods in a shaft 5 between floors 3 of the building as well as a drive 12 for moving the car 10 and a counterweight 11, and a control device 13 for controlling the drive 12. The installation can be any escalator installation 2 which comprises components such as steps for movement of passengers or goods between floors 3 of the building, balustrades 16, a drive 14 for moving the steps and a control device 15 for controlling the drive. As shown in FIG. 1, the present invention can also be realized in any roller belt installation 2', which comprises components such as belts for moving passengers or goods between floors 3 of the building or on the same floor 3, balustrades 16', a drive for moving the belts 14' and a control device 15' for controlling the drive. In the following for the sake of simplicity discussion is of the elevator installation 1 or the escalator installation 2 and like components of the roller belt installation 2' are identified with the same reference numeral with the prime symbol added. The elevator installation 1 or the escalator installation 2 can be a single elevator installation or a single escalator installation or, however, also several elevator installations or escalator installations, which are combined in terms of control into a group, in one or more buildings.

With respect to an input and recognition unit: the elevator installation 1 or escalator installation 2 is equipped with a data transmission device with an input and recognition unit 19 (FIG. 2). For example, the data transfer device is a modem 18, which is connected with a telephone network 23 and enables electronic feed of maintenance data of the elevator installation 1 or the escalator installation 2 into the telephone network 23. With knowledge of the present invention it is obviously also possible to use any other medium for data transmission, such as a postal transmission of a data carrier such as a compact disc. In this case the data transmission device 18 is a writing apparatus for writing a compact disc. The expert has here numerous possibilities of variation.

The input and recognition unit 19 can be located in the public or non-public region of the elevator installation 1 or escalator installation 2 or incorporated in an existing elevator, building or telecommunications infrastructure.

The input and recognition unit 19 is realized in FIG. 1 in a single apparatus. However, it is also conceivable to realize the appropriate functions in several apparatus which can be disposed at different locations. The input unit 19 enables input of at least one identification code and input of maintenance data of the elevator installation 1 or the escalator installation 2. The recognition unit 19 enables recognition of at least one admittance feature and detection of the duration of presence of at least one maintenance technician 20. In that case the presence, thus the physical presence, at the elevator installation 1 or escalator installation 2 of the maintenance technician 20 intended to carry out operations at the elevator installation 1 or escalator installation 2 is detected. If the input and recognition unit 19 is realized as two apparatus, these two can be so interconnected by way of a suitable medium, for example a communications line, a bus system, a local network, a telephone network, etc., that a data exchange is possible.

The identification of the maintenance technician 20 at the input and recognition unit 19 can thus be initiated either by input of an identification code at the input unit 19 and/or by recognition of an admittance feature by the recognition unit 19. Recognizable admittance features are, for example, mechanical or electronic keys, magnetic or electronic batch cards, electronic chip cards (transponders, GPS modules, etc.), mechanical admittance cards, individual biometric data (fingerprint, iris pattern, etc.) or the SIM card of a mobile telephone or the connection number in the landline network, etc.

An admittance feature can be recognized not only passively, but also actively. Thus, it is possible that the maintenance technician 20 inputs the admittance feature thereof himself or herself at the input and recognition unit 19 or introduces it into the input and recognition unit 19. However, it is also possible that the input and recognition unit 19 activates an electronic chipcard carried by the maintenance technician 20 or interrogates a digital identity card of the maintenance technician 20 or detects a biometric feature of the maintenance technician 20. It is also possible for the maintenance technician 20 to be identified on the basis of positional localization, for example of a transponder or a SIM card of a mobile telephone carried by the technician or a GPS module carried by the technician, in a network at the elevator installation or escalator installation. In these cases the recognition unit 19 comprises, for example, an antenna which identifies the SIM card or the GPS module.

The recognition unit 19 additionally comprises a comparison unit which compares the request data with one or more stored references. In the case of correspondence with the stored reference the maintenance technician 20 is recognized or identified. Through this identification the service center 30 knows which person or group of maintenance technicians 20 is concerned. Different identification codes can be provided for each person or person group. The comparison unit can be disposed at the elevator installation 1 or the escalator installation 2 and/or in the service center 30. For example, the comparison unit is located in the service center 30 remote from the elevator installation 1 or escalator installation 2 and receives from the recognition unit 19 of the elevator installation 1 or escalator installation 2 request data corresponding with the input identification code or the recognized admittance features or the positional localization of a SIM card or a GPS module. Communication of the request data from the elevator installation 1 or the escalator installation 2 to the remote service center 30 can be carried out by way of a suitable medium, such as, for example, the telephone network 23.

In the case of the elevator installation 1 or escalator installation 2 there can be defined different public and non-public regions to which different maintenance technicians 20 have access. Denoted as public region are locations and parts of the elevator installation 1 or escalator installation 2 which are accessible by any person without special authorization, such as the car 10. Non-public regions are accessible only by persons who have a special access authorization to the elevator installation 1 or escalator installation 2, for example to the building, such as the engine room 4 or shaft pit. Non-public regions are characterized by the fact that they are closed off with access limited, for example, by a door 17.

With respect to maintenance: Through the identification of the maintenance technician 20 the authorization thereof can be established. Applicable as maintenance are all maintenance operations which are carried out for delaying wear and/or for restoring the functional capability or operating capability inclusive of the technical safety of the elevator installation 1 or escalator installation 2 as well as the subassemblies and components thereof. Kinds of maintenance operations are, for example:

- Cleaning of non-publicly accessible parts of the elevator installation 1 or escalator installation 2, for example shaft pit or engine room 4.
- Periodic servicing operations such as cable change; bulb replacement; cleaning of components such as freeing electrical control units of dust; dismantling, cleaning and reassembling components such as the safety brake, etc.
- Servicing operations which were stipulated on the basis of travel performances or in other manner, for example checking of brakes, checking of cables, door closer.
- Repair operations due to technical deficiencies, for example adapting the height of the car/shaft stop.

In that case, distinction is between groups of persons with respect to which maintenance technicians 20 shall or may carry out which maintenance operations. Possible persons or person groups of maintenance technicians 20 are:

- Instructed operative undertaking possibly occurring expert operations, such as replacing lamps.
- Trained expert personnel rectifying technical deficiencies at the elevator installation 1 or escalator installation 2.
- Person working in the service center 30 and there, for example, evaluating data of the maintenance record of the elevator installation 1 or escalator installation 2.

These different maintenance technicians 20 can belong to different firms. Thus, the instructed operative can be employed by a servicing firm which undertakes servicing operations in the building. The expert operative undertakes actual maintenance operations at the elevator installation 1 or escalator installation 2 and here also has access to non-public areas of the elevator installation 1 or escalator 2. Through provision of different identification codes for the different maintenance technicians 20 it can be ensured that only appropriately authorized persons or groups of persons have access to the elevator installation 1 or escalator installation 2.

With respect to maintenance need: In addition, it is also conceivable that the elevator installation 1 or the escalator installation 2 detects its environment by sensors 21. The most diverse environmental conditions, such as, for example, temperature, conductivity, pressure, etc., can be detected with the help of, for example, electrical components and converted into electrical signals. In that case, the most diverse state data which the sensors 21 currently supply can be compared by way of an evaluating unit 22 with reference data filed in a memory of the evaluating unit 22. The reference data contain possible signal levels which can be supplied by the sensors 21. The evaluating unit 22 then supplies information about the state of the elevator installation 1 or the escalator installation 2. It is thereby possible to ascertain inter alia which parts of the elevator installation 1 or the escalator installation 2 have a maintenance need or which parts have been maintained. Thus, a statement about the maintenance state of the elevator installation 1 or the escalator installation 2 can be made.

For example, it is possible to detect the power take-up of the door drive, during closing of the shaft door 6, by sensors, as soon as the power take-up rises above a predefined reference value, a maintenance requirement can be reported to the surface center 30.

A maintenance need is present in the case of an installation part when cleaning or exchange of the component is required. For example, adjustment of the shaft door 6 may be required when these no longer close within a predetermined time or lamps have to be exchanged after a certain operating time in order to prevent unexpected disappearance of light in the car 10. This information can be communicated in the sequence from the evaluating unit 22 to the service center 30 or to the maintenance technicians 20.

With respect to the maintenance record: The input unit 19 additionally enables detection, by way of an interface, of data connected with maintenance operations at the elevator installation 1 or the escalator installation 2.

Advantageously this takes place by way of a keyboard. However, it is also possible to make such inputs by way of a barcode, a portable computer or another apparatus which is connected with the input unit 19 by way of the interface.

The detected data about the maintenance operations of the maintenance technician 20 are combined into a record. This maintenance record contains, for example, details about:

- Kind of maintenance.
- Identified maintenance technician 20 who has carried out the operations.
- Date of the maintenance operations.
- Operating times/cycles of the maintained components or of the elevator installation 1 or the escalator installation 2.
- Length of time the maintenance technician 20 was present.
- Replacement material/exchanged parts.
- Maintenance state, whether a need for maintenance operations at the elevator installation 1 or the escalator installation 2 is present, or the current state of the maintenance operations.

Advantageously, interrogations about the maintenance state or maintenance need, i.e. the maintenance operations at the elevator installation 1 or the escalator installation 2 to be carried out or due, can be actuated by way of the input and recognition unit 19. The corresponding maintenance operations can be allocated and listed for the maintenance technician 20 by the identification. The output takes place by way of, for example a monitor printer or portable computer which is connected with the elevator installation 1 or the escalator installation 2 by way of an interface.

With respect to maintenance need: Advantageously the maintenance need of the elevator installation 1 or the escalator installation 2 can be communicated to the service center 30. A maintenance need arises at the installation through expiry in terms of time or by a deficiency, for example by incorrect functioning or damage of the elevator installation 1 or the escalator installation 2. The maintenance technician 20 is thus already informed about the maintenance need before the technician is on site at the elevator installation 1 or the escalator installation 2 and can, by way of the prior information, make decisions about which persons, tools or systems have to be deployed at the elevator installation 1 or the escalator installation 2.

Figure 3:
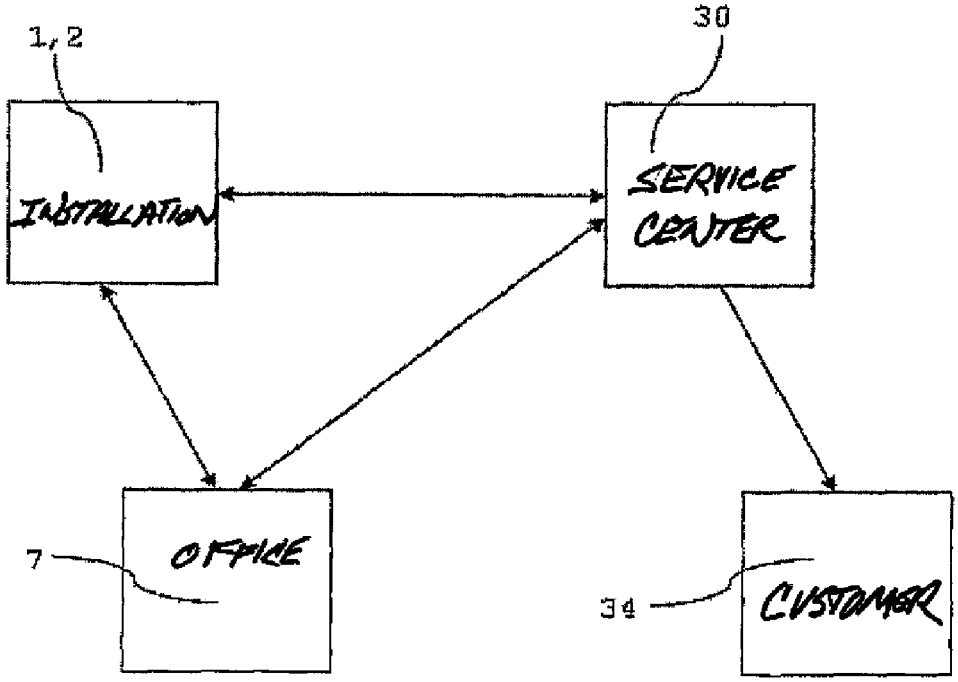
FIG. 3 shows, schematically, the communication of data between the elevator installation or escalator installation according to FIG. 1 and a service center or a building management office and a customer.

With respect to the service center 30: FIG. 3 shows the elevator installation 1 or the escalator installation 2 which is connected with a service center 30. The elevator installation 1 or the escalator installation 2 and the service center 30 are physically separate from one another. Quality-relevant and performance-relevant data such as, for example, the maintenance record of the elevator installation 1 or the escalator installation 2 are transmitted to the service center 30 by means of at least one data transmission device. Advantageously, the maintenance record is communicated to the customer 34 electronically by way of, for example, the modem 18 and/or as a postal transmission.

The maintenance record and further data of the elevator installation 1 or the escalator installation 2 can also be communicated to a building management office 7 and from there to the service center 30. It is also possible for the evaluation of the data to take place in the building management office 7. Various items of information about a building are available in a building management office 7. For example, the shaft door 6 is monitored by a video camera. If, for example, the shaft door 6 no longer closes the maintenance technician 20 can eliminate the cause at the corresponding floor 3. In addition to data about the elevator installation 1 or the escalator installation 2 these can be data of access control to the building or building parts smoke and fire alarms building air conditioning, energy flux, etc.

The maintenance record as well as further data communicated from the elevator installation 1 or the escalator installation 2 to the service center 30 can be viewed by the maintenance technician 20 in the service center 30 by way of a computer 32, which is connected with the data processing installation 31 by way of a data bus 33, and, for example, statistically evaluated.

The service center 30 can investigate the serviceability of the elevator installation 1 or the escalator installation 2 after the conclusion of the maintenance operations. On the basis of the details of the communicated maintenance record, the maintenance operations undertaken are known and selectively checked by suitable checking methods and sensors.

For example, a camera is mounted in the shaft pit or in the engine room and this camera can communicate to the service center 30 the state of cleaning after cleaning of the shaft pit or the engine room has been carried out. For this purpose the camera is activated from the service center 30 and this camera transmits image data from the shaft pit or the engine room to the service center.

For example, the power take-up of the drive on closing of a shaft door 6 is detected by at least one sensor. The service center 30 can investigate the serviceability of a serviced shaft door 6 in that this calls up the data of the sensor after maintenance and compares the data with reference values. If the power take-up lies below a predefined reference value, then the serviceability of the shaft door 6 is valid as given.

In the service center 30 the data relevant for invoicing customers 34 is linked by means of at least one data processing installation 31 with at least one operating parameter to form an invoice. The service center 30 and the customer 34 are physically separate from one another. By way of a data transmission device at least one invoice is communicated to the customer 34. Advantageously, the invoice is communicated to the customer 34 electronically and/or as a postal transmission.

The invoice communicated to the customer 34 contains statements about kind and location of the elevator installation 1 or the escalator installation 2. This can take place by a statement of the building address or by a numbering. Moreover, it is apparent to the customer 34 when and in which time period the work was performed. The data are stored at the service center 30 and serve, together with the maintenance record communicated by the building management office 7 or the input and recognition unit 19, for automatic invoicing.

With respect to quality standard: The maintenance record can serve as a basis for invoicing the customer 34. It is thus clearly apparent to the customer 34, who can be the owner of the elevator installation 1 or the escalator installation 2 or also only addressee of the invoice, which maintenance operations were carried out and when and by whom.

Advantageously a quality standard can be defined and checked by the maintenance record. Through the identification of the maintenance technician 20, the point in time of the presence as well as the maintenance state of the elevator installation 1 or the escalator installation 2 as well as further data from the maintenance record the quality of the installation can be more accurately monitored. The serviceability of the elevator installation 1 or the escalator installation 2 can be offered to the customer 34. The recording of maintenance data and the input and recognition unit 19 enable checking of the offered work. Thus, a quality standard can be offered to the customer, by which the customer himself or herself determines how reliably the availability of the elevator installation 1 or the escalator installation 2 must be.

Through the method according to the present invention it is made possible to move away from the traditional annual setting, which was to be undertaken in advance, of the costing for maintenance operations. Through registration and costing of maintenance periods which are shorter than a year there is made possible a corresponding increase in the frequency of maintenance payments by the customer 34. For example, maintenance payments take place at the rate of the maintenance periods, i.e. preferably quarterly, preferably monthly, preferably weekly. Obviously, with knowledge of the present invention also longer or shorter or even irregular maintenance periods are possible.

The invoice is divided up according to the kind of maintenance operations so that it is apparent to the customer 34 which costs were caused by which kind of maintenance operations.

Examples of maintenance operations for which an invoice is sent to the customer 34 are illustrated in the following.

EXAMPLE 1

The maintenance technician 20 is a caretaker who exchanges fluorescent tubes. In concrete terms the caretaker exchanges two fluorescent tubes in the elevator installation 1 and one fluorescent tube at the escalator installation 2. The caretaker identifies himself or herself by a batch card at the recognition unit 19. The identification code of the caretaker is "1008". The work and the material are charged individually to the customer 34. On identification, a list of assigned maintenance operations can be output. The list is created by the evaluating unit 22 and can be viewed by the maintenance technician 20 by way of a terminal at the input and recognition unit 19 or the building management office 7. The caretaker has one and the same identification code for both installations. The input and recognition unit 19 installed at the two installations detects what was carried out and at which installation. The costs for the working time and the material can be separately determined. In the case of routine operations flat-rate fixed times can be charged for the working times. By way of example, in the case of the elevator installation 1 a flat rate of 15 minutes for the provision of a replacement fluorescent tube as well as the exchange and disposal of the fluorescent tube can be charged. In the case of the escalator installation due to the more difficult access a flat rate of 20 minutes can be charged. The maintenance technician 20 confirms by input at the input and recognition unit 19 the carrying out of his or her maintenance operations in correspondence with a quality standard for the servicing operations.

EXAMPLE 2

As the maintenance technician 20, two trained experts carry out maintenance operations at the elevator installation 1 and the escalator installation 2 or change modules. A first expert identifies himself or herself by an identification code "2021" by mobile telephone at the input and recognition unit 19 or at the service center 30 and a second expert identifies himself or herself by an identification code "2035" by batch card at the input and recognition unit 19 or by telephone communication to the service center. By virtue of the position of the input and recognition unit 19 distinction can be made between the elevator installation 1 and the escalator installation 2. The evaluating unit 22 can assist the maintenance technician 20 to find the reason for the fault. The maintenance technician 20 is informed beforehand in his or her service center 30 by way of the telephone network 23. The technician can thus produce the resources in terms of personnel and material needed for the repair and take them along already on the first visit to the elevator installation 1 and the escalator installation 2.

The first maintenance technician 20 can identify himself or herself in various ways. For example, the position of the technician can be automatically ascertained by way of recognition of the SIM card of the mobile telephone of the technician and assigned the identification code "2021". The second maintenance technician 20 identifies himself or herself by the identification code "2035" of the technician directly at the input and recognition unit 19. The two maintenance technicians 20 carry out the maintenance operations together. The material is charged as an addition. It is also possible that the second maintenance technician 20 is recognized by way of the landline number of the telephone by which the technician reports to the service center 30 and the identification code "2035" is assigned to the technician. The quality of the work of a person can be assigned by the personal identification. After conclusion of the maintenance operations the service center 30 can check the functioning of the exchanged parts or the entire elevator installation 1 or the escalator installation 2.

EXAMPLE 3

A certain degree of serviceability of the elevator installation 1 or the escalator installation 2 is offered to the customer 34. The serviceability is expressed in percentage terms. It describes the ratio of a specific time period to the availability of the elevator installation 1 or the escalator installation 2 for use. The serviceability of the elevator installation 1 or the escalator installation 2 can be checked with the details from the maintenance record shown below:

| Maintenance and repair times: | |
|---|---|
| Elevator installation total | 15:39 h |
| power failure: | 01:05 h |
| user-caused | 00:02 h |
| cleaning | 04:43 h |
| maintenance | 01:20 h |
| faults | 04:39 h, of which peak-period 2:12 h |
| serviceability period 1.6.04-31.8.04 (92 days; 132,480 min) | 99.79% |
| serviceability peak-period (65 days per 3 h; 11,700 min) | 98.87% |
| Escalator installation total | 16:15 h |
| power failure: | 01:05 h |
| user-caused | 00:12 h |
| cleaning | 10:32 h |
| maintenance | 01:08 h |
| faults | 03:15 h, of which peak-period 0:12 h |
| serviceability period 1.6.04-31.8.04 (92 days; 132,480 min) | 99.85% |
| serviceability peak-period (65 days per 3 h; 11,700 min) | 99.99% |

In that case power failures or failures caused by the user do not influence serviceability, since they do not lie in the region of influence of the service center 30. Cleaning and maintenance are similarly excluded due to their capability of being planned.

In the case of serviceability distinction can be further made between total serviceability over a certain period of time and serviceability with respect to a specific period of time within a time period in, for example, the peak period. The two values can be individually agreed with the customer 34. Thus, a specific percentage of serviceability of the elevator installation 1 or the escalator installation 2 can thus be sold to the customer 34.

In accordance with the provisions of the patent statutes the present invention has been described in what is considered to represent its preferred embodiment. However, it should be noted that the invention can be practiced otherwise than as specifically illustrated and described without departing from its spirit or scope.

What is claimed is:

1. A method for maintenance of an elevator installation or an escalator installation, comprising the steps of:

communicating a presence of at least one maintenance technician at the elevator installation or the escalator installation to a remote service center;

detecting, using a recognition unit at the elevator installation or the escalator installation, maintenance operations carried out by the at least one maintenance technician at the elevator installation or the escalator installation; and recording the detected maintenance operations as a maintenance record for use after the maintenance operations are completed.

2. The method according to claim 1 including identifying the at least one maintenance technician at the elevator installation or the escalator installation.

3. The method according to claim 2 wherein the at least one maintenance technician is identified by recognition of at least one of at least one identification code, at least one admittance feature, and positional localization in a network at the elevator installation or escalator installation.

4. The method according to claim 1 including communicating the maintenance record to the service center.

5. The method according to claim 1 including checking serviceability of the elevator installation or the escalator installation by the service center after conclusion of the maintenance operations.

6. The method according to claim 1 including communicating the maintenance record by the service center to a customer associated with the elevator installation or the escalator installation.

7. The method according to claim 1 including ascertaining a maintenance requirement by the elevator installation or the escalator installation and reporting the maintenance requirement to the service center or to the at least one maintenance technician.

8. The method according to claim 1 including communicating state data of the elevator installation or the escalator installation to the service center, based on this state data determining a maintenance requirement by the service center and reporting the maintenance requirement to the at least one maintenance technician.

9. The method according to claim 1 including determining a maintenance state by the elevator installation or the escalator installation and displaying the maintenance state.

10. A service center configured to perform a method for maintenance of an elevator installation or an escalator installation, the method comprising the steps of:

receiving an indication of a presence of at least one maintenance technician at the elevator installation or the escalator installation; and recording maintenance operations completed by the at least one maintenance technician at the elevator installation or the escalator installation as a maintenance record for use after the maintenance operations are completed, wherein the maintenance record includes details about kind of maintenance, length of time the maintenance technician was present, and operating times/cycles of maintained components of the elevator installation or the escalator installation.

11. A device comprising:

a recognition unit configured to be arranged at an elevator installation or an escalator installation, the recognition unit being configured to recognize at least one identification code of a maintenance technician or at least one admittance feature of the maintenance technician, the recognition unit being further configured to record a location of the maintenance technician at the elevator installation or the escalator installation and further configured to detect maintenance operations carried out at the elevator installation or the escalator installation;

said device being configured to create a maintenance record of the maintenance operations at the elevator installation or the escalator installation; and said device being configured to communicate the maintenance record to a remote service center for use after the maintenance operations are completed.

12. The device according to claim 11 wherein a presence of the maintenance technician is communicated to the remote service center by said device.

13. The device according to claim 11 wherein said device communicates a recognized identification code or a recognized admittance feature or the recorded location of the maintenance technician to the remote service.

14. An installation comprising:

at least one elevator or at least one escalator; and at least one recognition unit coupled to the at least one elevator or the at least one escalator, the at least one recognition unit being configured to detect maintenance work performed on the installation, the installation being configured to transmit a record of the detected maintenance work to a service center.

* * * * *